US006817123B2

(12) United States Patent
Okazaki et al.

(10) Patent No.: US 6,817,123 B2
(45) Date of Patent: Nov. 16, 2004

(54) DISPLAY DEVICE

(75) Inventors: Norihiko Okazaki, Yokohama (JP); Takao Niihara, Tokyo (JP); Hisao Shimizu, Yokohama (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 10/032,579

(22) Filed: Jan. 2, 2002

(65) Prior Publication Data

US 2002/0059742 A1 May 23, 2002

(51) Int. Cl.[7] ..... G09F 13/22

(52) U.S. Cl. ..... 40/452; 40/463; 40/541; 340/815.45; 345/82

(58) Field of Search ..... 40/452, 463, 541, 40/550, 624, 605, 544; 340/815.45, 815.53; 345/82, 59

(56) References Cited

U.S. PATENT DOCUMENTS 4,384,317 A * 5/1983 Stackpole ..... 362/183
5,819,455 A * 10/1998 Tsuda ..... 40/580
6,271,814 B1 * 8/2001 Kaoh ..... 345/82
6,314,669 B1 * 11/2001 Tucker ..... 40/448
6,384,877 B1 * 5/2002 Socias Batet et al. ..... 348/842
6,508,171 B1 * 1/2003 Georges ..... 101/483

FOREIGN PATENT DOCUMENTS

JP 2000-181386 6/2000

* cited by examiner

*Primary Examiner*—William L. Miller
(74) *Attorney, Agent, or Firm*—Parkhurst & Wendel, L.L.P.

(57) ABSTRACT

In a display device, a display surface portion includes a light emitting area on which a plurality of light emitting devices are arranged, and a nonluminous area formed on spaces among the arranged light emitting devices on the display surface portion. The nonluminous area is formed with a nonluminous image and the nonluminous image is displayed on the nonluminous area in color. An emission unit for selectively causing at least one of the light emitting elements to emit light so as to display an image on the display surface portion.

6 Claims, 6 Drawing Sheets

DISPLAY DEVICE

BACKGROUND OF THE INVENTION

1. Field of the Invention

The present invention relates to a display device applied to a signboard attached to a ceiling, a wall surface or the like of a building.

In particular, the present invention relates to a display device for causing a plurality of light sources arranged on a display surface thereof to emit light so as to display, at night, still images, character data, video images or the like.

2. Description of the Prior Art

Conventional methods for displaying a large size image at the top of a building or on a wall surface thereof include posting a color film or a color poster on a flat surface so as to illuminate the flat surface on a front side thereof with a lamp. This method permits viewers to recognize the illuminated color film or color poster at night.

Conventional methods for displaying a large size image at the top of a building or on a wall surface thereof also include illuminating the flat surface on which the color film or the color poster is posted on a backside of the flat surface with a light source disposed thereon, and causing neon tubes which are deformed to form a predetermined shape to emit light at night.

Moreover, a conventional method for displaying arbitrary still images or video images as large size images with a large-sized image display panel is well-known. On the large-sized image display panel, light emitting elements, such as discharge tubes, light bulbs, light-emitting diodes or other similar emitting devices, are so arranged to form a matrix shape.

Furthermore, a conventional method for displaying still images as large side images on a display device such as Q board is familiar. On the display surface of the display device, a plurality of cuboidal display elements whose surfaces are applied to red, blue, green, white and so on, respectively, are mounted so as to rotate by magnetic force, thereby displaying the still images.

Each of the display device with the flat surface on which the poster or the like is posted and the display device with the neon tubes can be designed at relatively low cost, whereas it has a disadvantage such that the displayed presentation must be fixed. In particular, in cases where no lighting devices are provided, it is impossible to visibly recognize the displayed presentation on the posting display device at night.

In addition, the automatic large-sized image display panel allows freedom of presentation to be increased because of dealing with video images in addition to the still images.

The large-sized image display device, however, has a disadvantage such that it is costly and requires much power consumption because, in order to form an image which can be visible in the daytime, the brightness of the image must exceed that caused by a reflection of outside light represented by sunlight and so on.

Furthermore, the magnetic rotating type of display device has low power consumption, but it cannot display animations, video images and so on, which have fast frame speeds, respectively.

SUMMARY OF THE INVENTION

The present invention is directed to overcome the foregoing disadvantages. Accordingly, it is an object of the present invention to provide a display device which is capable of taking advantage of a posting display device and and automatic light emitting display device so as to serve as a posting signboard making use of sunlight in the daytime and as an automatic light emitting display device for displaying images at night, thereby improving expressive power of the display device with its cost low.

According to one aspect of the present invention, there is provided a display device comprising a display surface portion including a light emitting area on which a plurality of light emitting devices are arranged, and a nonluminous area formed on spaces among the arranged light emitting devices on the display surface portion, the nonluminous area being formed with a nonluminous image, the nonluminous image being displayed on the nonluminous area in color; and emission means for selectively causing at least one of the light emitting elements to emit light so as to display an image on the display surface portion.

According to this aspect of the present invention, it is possible to visibly recognize the nonluminous image on the display surface portion in the daytime, and, at night, by causing at least one of the light emitting elements to emit light, the image formed by the selectively emitted light of at least one of the light emitting elements.

This aspect of the present invention has an arrangement of comprising a device body to which the light emitting elements are disposed, wherein the display surface portion includes a front panel having a plurality of through holes and a transparent seat mounted on the front panel, the through holes corresponding to the light emitting elements, the nonluminous area being formed on the transparent seat, the front panel being attached to the device body so that the through holes are opposite to the light emitting elements, respectively.

According to the preferred embodiment of this aspect, it is possible to prevent light leaking from the light emitting elements at night, thereby improving a display effect when the outside light is weak. The replacement of the front panel causes the displayed nonluminous image to be easily changed into new different nonluminous image.

In a preferred embodiment of this aspect, the nonluminous image on the nonluminous area of the transparent seat is formed with transparent coloring matter.

According to this preferred embodiment of this aspect, it is possible to easily change the displayed nonluminous image into a new different nonluminous image by removing the seat to post a new seat on which the new different nonluminous image is formed.

In the preferred embodiment of this aspect, the device body includes supporting members for fixedly supporting the light emitting elements, the nonluminous area being formed on the front panel, the front panel being attached to the supporting members of the device body so that the through holes are opposite to the light emitting elements, respectively.

Accordingly to the preferred embodiment of this aspect, because the supporting members support simultaneously the light emitting elements and the front panel, accurately setting of the attachment position of the light emitting elements to the support members and the attachment position of the front panel permits the light emitting elements and the through holes to be located accurately opposite to each other.

In the preferred embodiment of this aspect, each of the light emitting elements is a light emitting diode.

According to the preferred embodiment of this aspect, because the light emitting diode has a relatively compactsized light emitting element, it is possible to minimize the light emitting area, as compared with using discharge bulb or a light bulb, by using a relatively compact light emitting diode, thereby improving the visibility of the nonluminous image.

BRIEF DESCRIPTION OF THE DRAWINGS

Other objects and aspects of the present invention will become apparent from the following description of an embodiment with reference to the accompanying drawings in which.

DETAILED DESCRIPTION OF EMBODIMENTS

Embodiments of the present invention will be described hereinafter with reference to the accompanying drawings.

Figure 1:
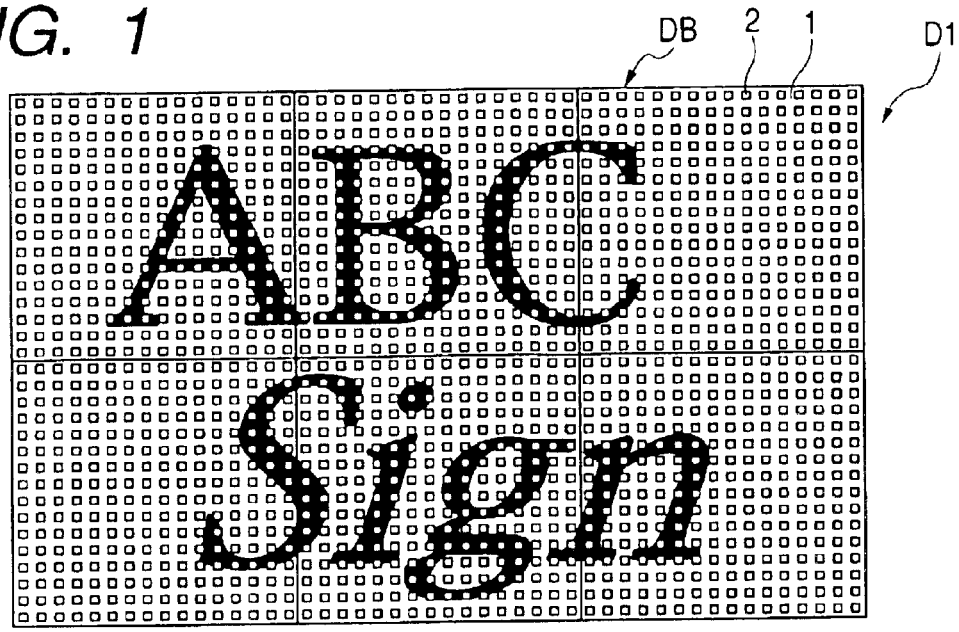
FIG. 1 is a front view showing an appearance of a display device according to a first embodiment of the present invention.
Figure 2:
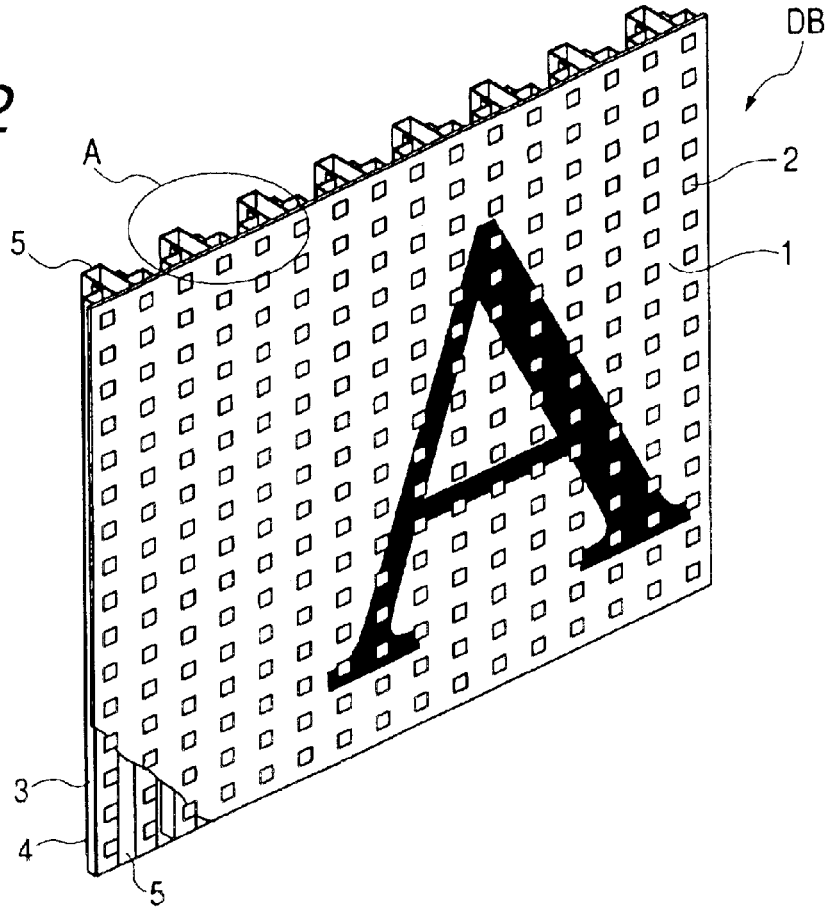
FIG. 2 is a perspective view showing a configuration of the display block shown in FIG. 1.
Figure 3:
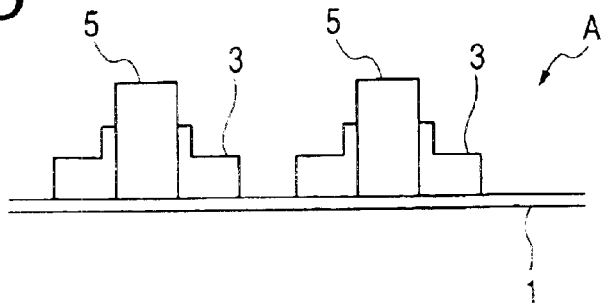
FIG. 3 is a plane view showing a portion A of the display block illustrated in FIG. 2.

FIG. 1 is a front view showing an appearance of a display device according to a first embodiment of the present invention. FIG. 2 is a perspective view showing a configuration of the display block shown in FIG. 1. FIG. 3 is a plane view showing a portion A of the display block illustrated in FIG. 2.

The display device D1 is provided with a front panel 1 on which a design including at least one character or at least one picture is formed as an image. The design is formed by applying at least one coating to the front panel 1, printing the design on the front panel 1, or posting a seat member or a poster on which the design is printed thereon.

The front panel 1 is formed at its front surface with a plurality of through holes 2 arranged to form a substantially matrix shape, each of which has, for example, a substantially rectangular shape. Each of the through holes 2 can take an arbitral shape. The front panel 1 is also formed at its back surface with a plurality of display modules 3. Each of the display modules 3 is formed with light emitting cells 4. The display device D1 is also provided with a plurality of rectangular rod-like steel pipes 5 arranged in parallel at regular intervals.

That is, each of the through holes 2 has 20 mm squares so that the through holes 2 are arranged in parallel at regular intervals of 60 mm. Each of the intervals is defined as a distance between centerlines of each of the adjacent through holes 2. The steel pipes 5 support the front panel 1 and they are disposed to, for example, frames of advertising tower of a building or a wall surface thereof and arranged in regular intervals.

The steel pipes 5 are arranged on alternate intervals of the through holes 2.

As shown in FIG. 3, the plurality of display modules 3 are fixedly disposed on both sides of the steel pipes 3 so as to be parallel to one vertical side of the front panel 1 in a state shown in FIG. 2 and to be arranged in a straight. The light emitting cells 4 are arranged in a straight on each of the display modules 3 at intervals of 60 mm. The size of each the display modules 3 or that of each of the steel pipes is designed so that the interval of the adjacent light emitting cells 4 of the adjacent display modules 3 is 60 mm in length.

When installing the front panel 1 on the steel pipes 5, the vertical columns of the light emitting cells 4 of the display modules 3 on both sides of the steel pipes 5 are fit to the vertical columns of the through holes 2, which opposite to the display modules 3. This causes the light emitting cells 4 to be arranged to form a substantially matrix shape, thereby providing the display device D1 for displaying image by a combination of selectively emitting dots (pixels) formed by light emitting cells 4 each of which corresponds to one dot (pixel).

Incidentally, hereinafter, 16×16 matrix of light emitting cells 4 which comprises 16 display modules 3 arranged in parallel is taken as one display block DB so that, in FIG. 1, the display device D1 is configured to combine six display blocks DB so as to arrange the six display blocks DB in two lateral rows and three vertical columns.

Figure 4:
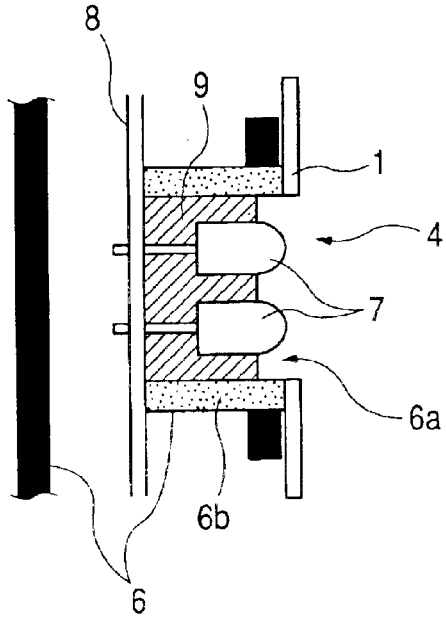
FIG. 4 is a longitudinally sectional view showing an inner configuration of the display module shown in FIG. 2.
Figure 5:
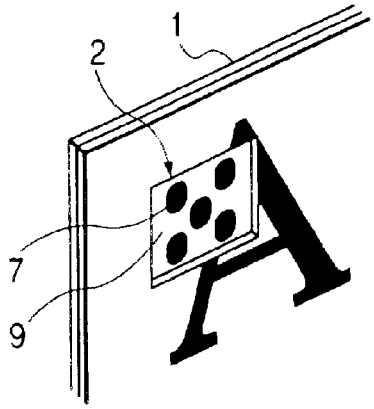
FIG. 5 is a perspective view showing a configuration of a light emitting cell shown in FIG. 4.

FIG. 4 is a longitudinally sectional view showing an inner configuration of the display module 3 and FIG. 5 is a perspective view showing a configuration in the vicinity of the light emitting cell 4 and the periphery thereof shown in FIG. 4.

The display module 3 is provided with a case 6 formed as a substantially rectangular tubular shape, a plurality of light emitting diodes 7, a printed circuit board 8 and so on so that the light emitting diodes 7, the printed circuit board 8 and so on are installed in the case 6.

The case 6 is formed at its front panel side surface (front surface) with longitudinally 16 holes 6*a* in regular intervals of 60 mm, and with a plurality of projections 6*b* each having a substantially cylindrical shape and projecting inwardly to a back side surface of the case 6 from the periphery of each hole 6*a*. The printed circuit board 8 is interposed between the front surface and back surface of the case 6.

This display block 3 also has a plurality of light emitting diodes 7 arranged correspondingly to the intervals of the holes 6*a* and mounted on the printed circuit board 8. On opposite surface of the printed circuit board 8, which is opposite to the surface on which the light emitting diodes 7 are mounted, circuit components are mounted for operating the light emitting diodes 7.

The printed circuit board 8 is adhered on the projections 6*b* so as to be fixed to the case 6 so that the light emitting diodes 7 are freely fit in the corresponding projections 6*b*. After the printed circuit board 8 is fixed to the case 6, injecting silicon resin 9 for waterproofing in the projections 6*b* causes terminals of the light emitting diodes 7 and their peripheries to be sealed.

As the silicon resin 9 is injected, as shown in FIG. 5, upper sides (front panel sides) of the light emitting diodes 7 are exposed through the through holes 2 to the outside so that a part of the silicon resin 9 can be visible at a front side of the front panel 1.

In this embodiment, five light emitting devices 7 including a blue light emitting diode, two green light emitting diodes and two red light emitting diodes are arranged in each of the projections 6*b* so as to configure the light emitting cell 4. This configuration allows a multicolor display and an adjustment of white balance.

Figure 6:
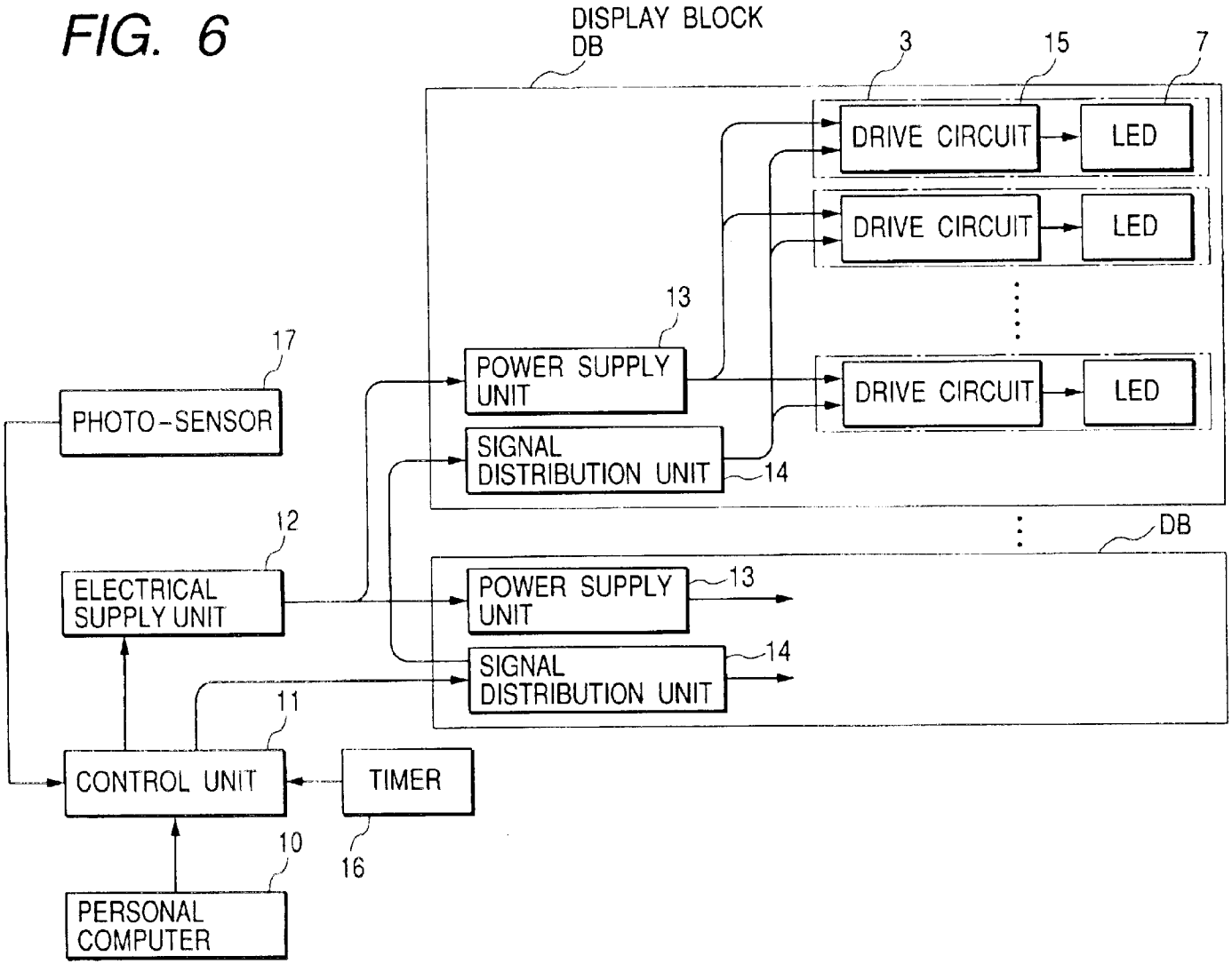
FIG. 6 is a block diagram of a control system in the display device for supplying power to each of the display modules therein according to the first embodiment.

FIG. 6 is a block diagram of a control system in the display device D1 for supplying power to each of the display modules 3 therein.

That is, the display device D1, as the control system, comprises a control unit 11 for producing display data which make each of the display blocks DB emit light according to image data in the personal computer 10.

The display device D1 also comprises an electrical supply unit 12 for supplying power to each of the display blocks DB, a power supply unit 13 provided in each of the display blocks DB for supplying the power supplied from the electrical supply unit 12 to each of the display modules 3 of each of the display blocks DB and a signal distribution unit 14 provided in each of the display blocks DB for distributing display data to the display modules 3 of each of the display blocks DB.

The display device 1 also comprises a drive circuit 15 provided in each of the display modules 3 for driving each of the light emitting diodes (LED) 7 in each of the display modules 3, a timer 16 for setting times at which the control unit 11 turns the electrical supply unit 12 on and off and a photo-sensor 17 for sensing illumination intensity on the front panel 1.

Image signals representing a still image, sequential still images or moving images displayed on the personal computer 10 are inputted to the control unit 11 so as to be processed, thereby producing a display data. The display data is transmitted from the control unit 11 so as to be transferred to each of the signal distribution units 14 in each of the display blocks DB. At least one of the drive circuits 15 of at least one of the display modules 3 of at least one of the display blocks DB drives at least one of the light emitting cells 4 in the at least one of the display modules 3 according to the display data distributed by each of the distribution units 14, causing at least one of the light emitting cells 4 to emit light. As a result, the image signals displayed on the personal computer 10 are displayed as the image on the front panel 1.

The electric supply to each of the display blocks DB by the electric supply unit 12 is controlled by the control unit 11 according to an output signal from the timer 16 or the photo-sensor 17, or output signals from them.

At first, the control according to the output signal from the timer 16 is described hereinafter.

The timer 16 has a function for generating a power supply start signal at a first setting time and a power supply stop signal at a second setting time. When the control unit 11 detects the power supply start signal generated by the timer 16, outputs, to the electric supply unit 12, a command for starting the power supply to each of the display blocks DB. On the other hand, when the control unit 11 detects the power supply stop signal generated by the timer 16, outputs, to the electric supply unit 12, a command for stopping the power supply to each of the display blocks DB.

Then, for example, setting sunset time as the first setting time and sunrise time as the second setting time permits, in the daytime, the image formed on the front panel 1 to be displayed, and, at night, the image formed by the combination of the light emitting cells 4 to be displayed. Incidentally, the sunset time and sunrise time may be annual average sunset time and annual average sunrise time. The timer 16 may have a table storing therein all sunset times and sunrise times for the year so as to set the first setting time and the second setting time on the basis of the table.

Next, the control according to the output signal from the photo-sensor 17 is described hereinafter.

The control unit 11 monitors the illumination intensity on the front panel 1 according to the output signal (the illumination signal) from the photo-sensor 17. When the control unit 11 determines that the illumination intensity on the front panel 1 is smaller than predetermined threshold illumination intensity, it outputs, to the electric supply unit 12, a command for starting the power supply to each of the display blocks DB. On the other hand, when the control unit 11 determines that the illumination intensity on the front panel 1 is larger than the predetermined threshold illumination intensity, it outputs, to the electric supply unit 12, a command for stopping the power supply to each of the display blocks DB.

Then, for example, the threshold illumination intensity is defined as the illumination intensity adjacent to the front panel 1 caused by the light emitted from each of the light emitting cells 6. When ambient light is that in which the image signals on the personal computer 10 are recognizable, the power supply provides power to each of the display blocks DB, whereas, when the ambient light is that in which the image located on the front panel 1 is recognizable, the power supply to each of the display blocks DB is stopped.

Using both of the timer 16 and the photo-sensor 17 may control of the start/stop of the power supply. For example, the control unit 11 may control the start of the power supply on the basis of the sensed illumination intensity by the photo-sensor 17 according to the change of the illumination in the environment of the front panel 1, and the stop of the power supply at the predetermined times based on the output signals from the timer 16.

The control unit 11 usually may control the electric supply unit 12 at regular timings based on the output signals from the timer 16 so as to display the image on the basis of the light emitting diodes 7 and to stop the display of that, and, when outside light is blocked with, for example, a cloud at an unexpected time different from the output timings of the timer 16, may detect that the sensed illumination density by the photo-sensor 17 is not more than the threshold illumination density so as to display the image on the basis of the light emitting diodes 7.

Furthermore, while the control unit 11 controls the electric supply unit 12 at regular timings based on the output signals from the timer 16 so as to display the image on the basis of the light emitting diodes 7 at night, when the lighting of, for example, signboard arranged around the display device D1 turns on, or that emits light with respect to the display device D1, the control unit 11 may stop the display of the image based on the light emitting diodes 7 according to the sensed illumination density by the photo-sensor 17.

Figure 7:
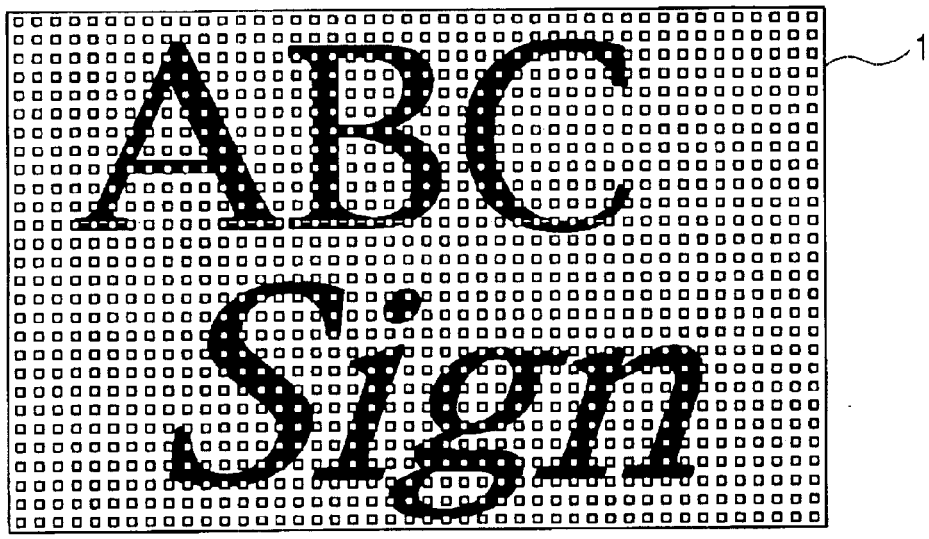
FIG. 7 is a front view showing a state of a front panel of the display device in the daytime according to the first embodiment of the present invention.
Figure 8:
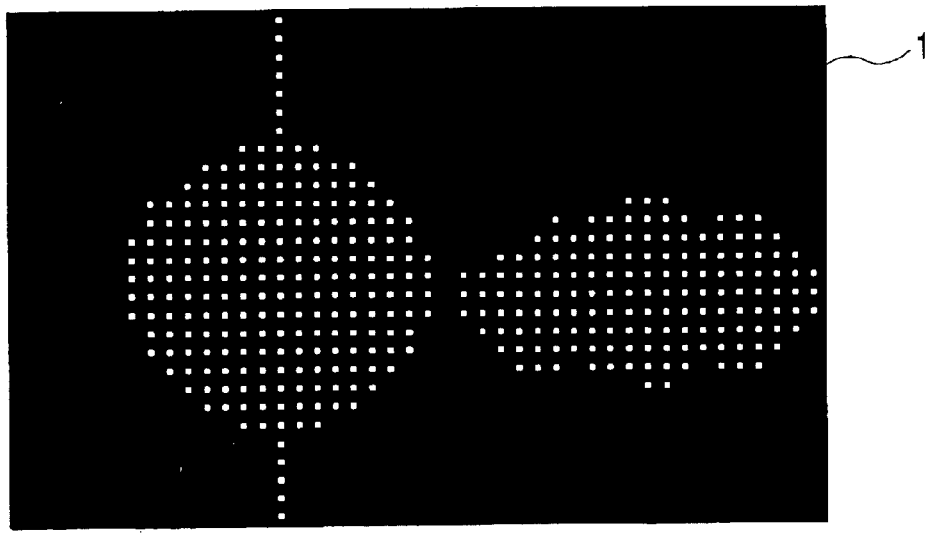
FIG. 8 is a front view showing a state of a front panel of the display device at night according to the first embodiment of the present invention.

The above configuration of the present invention permit, in the daytime, as sown in FIG. 7, the display device D1 to be served as the poster signboard and, at night, as shown in FIG. 8, it to be served as the automatic light emitting display device, causing still image, sequential still images or moving images to be displayed on the display device D1, making it possible to richly expressive images on the display device D1.

For example, the image shown on the display device D1 in FIG. 8 permits the expression of the sun shining and that of the cloud moving. The use of the light emitting diodes 7 as light emitting elements in the light emitting cells 4 causes the power of the display device D1 to be saved and the lifetime of that to be lengthened, as compared with using discharge tubes or light bulbs as the light emitting elements.

Incidentally, an area of the through hole 2, a shape thereof and an interval between adjacent through holes 2 may be set according to the place to which the display device D1 is disposed. It is preferable to enlarge an area except for the through holes 2 on the front panel 1 in order to keep the visual recognition of the image formed on the front panel 1.

It is desirable to minimize the area of each of the through holes 2 and to increase a number of the through holes 2, as one example, as compared with enlarging, the area of each of the through holes 2, as another example, even if total areas of all of the through holes 2 according to the one example are the same as those of all of the through holes 2 according to the another example.

In the present embodiment, each of the through holes 2 has 20 mm squares so that the through holes 2 are arranged in parallel at regular intervals of 60 mm. According to the configuration, only when viewing the front panel 1 from a place at a very close distance from the front panel 1, the through holes 2 can be recognized so that, when visibly recognizing the front panel 1 from a place at a distance of 50 m from the front panel 1, viewers do not recognize existences of the through holes 2 at all.

If the top (front) portion of the light emitting diode 7 is positioned to be excessively recessed with respect to the front panel 1, that is, recessed behind front panel, then visibility of the diode 7 at night will be compromised. On the other hand, if a top portion of the light emitting diode 7 is positioned to excessively project from the front panel 1, some light will illuminate the surrounding surface of the through hole 2 in the front panel 1, thereby causing the image located on the front panel 1 to be visible at night. Also, if the top portion of the light emitting diode 7 is positioned to excessively project with respect to the front panel 1, a shadow due to the sunlight will spoil the appearance of the image formed on the front panel 1.

The top portion of the light emitting diode 7, therefore, preferably is slightly recessed with respect to the front panel 1.

Figure 9:
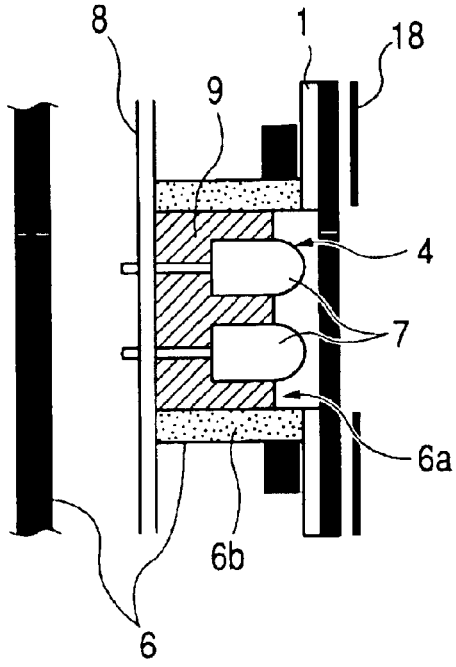
FIG. 9 is a longitudinally sectional view showing a main part of a display device according to a second embodiment of the present invention.
Figure 10:
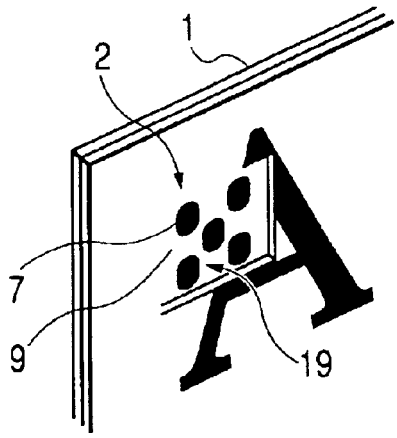
FIG. 10 is a perspective view showing a configuration in a vicinity of a light emitting cell shown in FIG. 9.

FIG. 9 is a longitudinally sectional view showing an inner configuration of a main part of a display device according to a second embodiment of the present invention. FIG. 10 is a perspective view showing a configuration in the vicinity of the light emitting cell 4. Incidentally, elements which are the same as those in the first embodiment shown in FIG. 4 and FIG. 5, or have the same functions of those therein, are assigned to the same reference numerals of the elements in the first embodiment shown in FIG. 4 and FIG. 5, omitting the explanation of the elements in FIG. 4 and FIG. 5 in detail.

The display device D1 in this second embodiment comprises a transparent layer 18 located on the front panel 1 so that a design including at least one character or at least one picture is formed as an image on the transparent layer 18 in place of the front panel 1. The transparent layer 18 is formed with a plurality of transparent portions 19 arranged to correspond to the through holes 2, respectively. No image is formed on the transparent portions 19.

That is, the transparent portions 19 are arranged to form a matrix and each of the transparent portions 19 has 20 mm squares.

The layer 18 is located on the front panel 1 so that each of the transparent portions 19 coincides with each of the through holes 2, thereby forming the image on the front panel 1.

The configuration of the second embodiment, in cases of changing the displayed image on the display device, can change the displayed image on the display device by changing the layer 18 so as to locate a new layer 18' on which another image is formed, making it possible to change the displayed image without removing the front panel 1.

Figure 11:
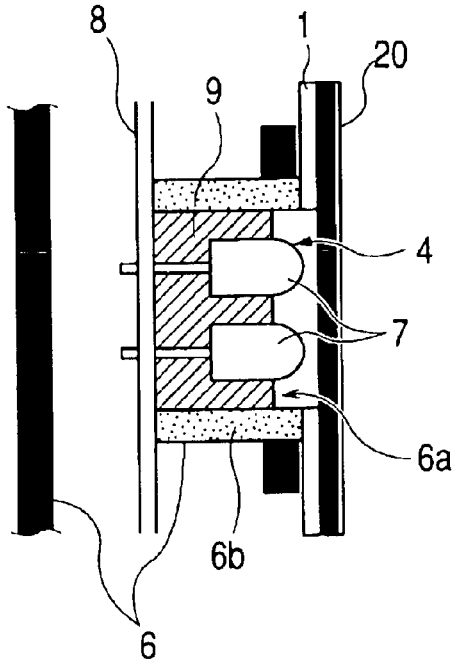
FIG. 11 is a longitudinally sectional view showing a main part of a display device according to a third embodiment of the present invention.
Figure 12:
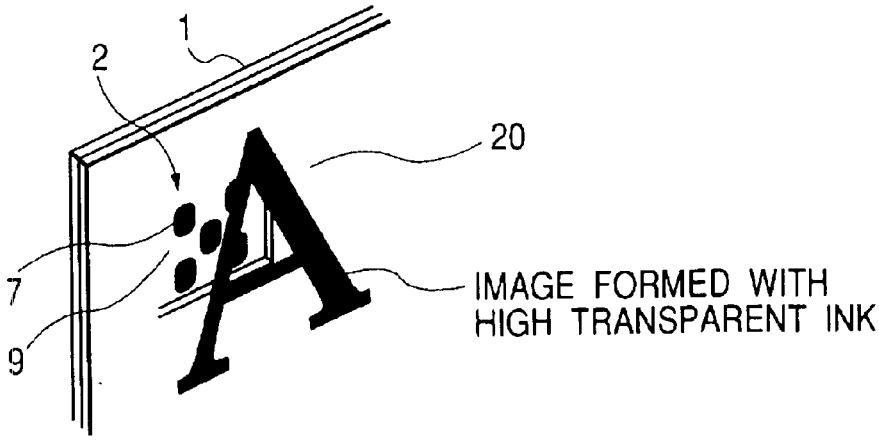
FIG. 12 is a perspective view showing a configuration in a vicinity of a light emitting cell shown in FIG. 11.

FIG. 11 is a longitudinally sectional view showing an inner configuration of a main part of a display device according to a third embodiment of the present invention. FIG. 12 is a perspective view showing a configuration in the vicinity of the light emitting cell 4. Incidentally, elements which are the same as those in the second embodiment shown in FIG. 9, or have the same functions of those therein, are assigned to the same reference numerals of the elements in the second embodiment shown in FIG. 9, omitting the explanation of the elements in FIG. 9 in detail.

The display device D1 in this third embodiment comprises a transparent layer 20 located on the front panel 1 so that a design including at least one character or at least one picture is formed with a high transparent ink having photo transmission on the transparent seat 20 in place of the front panel 1.

This configuration permits the light emitted from the light emitting cell 4 to be radiated through the ink on the seat 20 to the outside of the front panel 1. In this case, though the amount of light radiated to the outside is more decreased as compared with the second embodiment, it is possible to make inconspicuous the through hole 2 and the light emitting cell 4 in the daytime.

The present invention is not limited to the above first~third embodiments. For example, in the first, second and third embodiments, as the light emitting element of the light emitting cell the light emitting diode is used, but the present invention is not limited to the structure. As the light emitting element, a small bulb, a neon tube or an optical fiber may be used. In the first, second and third embodiments, the light emitting cell is configured by the plurality of light emitting diodes, permitting the image to be displayed in color. The present invention, however, may permit the image to be displayed in monocolor.

The image pictured on the front panel 1 is formed by means of application of coating, printing, a photograph or the like so that any image forming means can be used only when images formed by any image forming means can be visibly recognized.

Changing the displayed image based on the light emitting diodes 7 is relatively easy as compared with changing the image formed on the front panel 1 because, in cases of changing the image on the front panel 1, recoat work or seat replacement work must be required. Usually, the image formed on the front panel 1 may be displayed, and, information needing continuously updating, information requiring quickly report, arbitrarily determined information or the like may be displayed as the image based on the light emitting diodes 7 at desirable timings independently of the state of the outside light. In this configuration, the personal computer 10 may be operative to control the power supply start timing, the stop timing of the power supply, the light emitting luminance and so on without regard to the states of the timer 16 and the photo-sensor 17.

While there has been described what is at present considered to be the preferred embodiment and modifications of the present invention, it will be understood that various modifications which are not described yet may be made therein, and it is intended to cover in the appended claims all such modifications as fall within the true spirit and scope of the invention.

What is claimed is:

1. A display device comprising:

a display surface portion comprising a light emitting area on which a plurality of light emitting elements are located with spaces therebetween, said spaces defining a nonluminous area on which a nonluminous image is located and visible without the light emitting elements;

emission means for selectively causing at least one of the light emitting elements to emit light for displaying a luminous image on the display surface portion;

means for sensing illumination density on the display surface portion; and a timer for generating a power supply start signal at a first predetermined time and a power supply stop signal at a second predetermined time, wherein said emission means comprises:

means for starting to supply power to said at least one of the light emitting elements when the power supply start signal is generated by the timer;

means for stopping supplying power to said at least one of the light emitting elements when the power supply stop signal is generated by the timer;

means for switching off power to said at least one of the light emitting elements when, while power is supplied to said at least one of the light emitting elements according to the power supply start signal from the timer, the sensed illumination density is larger than a predetermined threshold illumination density; and means for switching on power to said at least one light emitting element when, while no power is supplied to said at least one of the light emitting elements as a result of control caused by the power supply stop signal from the timer, the sensed illumination density is smaller than a predetermined threshold illumination density.

2. The display device according to claim 1, further comprising a device body on which the light emitting elements are located, wherein said display surface portion comprises a front panel having a plurality of through holes, said front panel being attached to the device body so that the through holes align with respective emitting elements, and said front panel defines said nonluminous area.

3. The display device according to claim 2, wherein said device body comprises supporting members for fixedly supporting the light emitting elements, and said front panel is attached to the supporting members of the device body so that the through holes are aligned with respective light emitting elements.

4. The display device according to claim 1, further comprising a device body on which the light emitting elements are located, wherein said display surface portion comprises a front panel having a plurality of through holes, said front panel being attached to the device body so that the through holes align with respective light emitting elements, and a transparent layer is located on the front panel, said transparent layer defining said nonluminous area.

5. The display device according to claim 4, wherein said nonluminous image on the nonluminous area of the transparent layer comprises transparent coloring matter.

6. The display device according to claim 1, wherein each of said light emitting elements is a light emitting diode.

* * * * *